US008141597B2

(12) United States Patent
Chassaing

(10) Patent No.: US 8,141,597 B2
(45) Date of Patent: Mar. 27, 2012

(54) INSTALLATION FOR FILLING AN AEROSOL CONTAINER WITH LIQUID, SUCH AS PAINT

(75) Inventor: Antoine Chassaing, Clevilliers (FR)

(73) Assignee: Fillon Technologies, Faverolles (FR)

( * ) Notice: Subject to any disclaimer, the term of this patent is extended or adjusted under 35 U.S.C. 154(b) by 854 days.

(21) Appl. No.: 12/236,524

(22) Filed: Sep. 24, 2008

(65) Prior Publication Data

US 2009/0078333 A1 Mar. 26, 2009

(30) Foreign Application Priority Data

Sep. 24, 2007 (FR) ..... 07 06656

(51) Int. Cl.
*B65B 31/00* (2006.01)
*B65B 3/04* (2006.01)

(52) U.S. Cl. ..... 141/20; 141/3; 141/97; 141/369

(58) Field of Classification Search ..... 141/18, 141/20, 21, 94, 97, 369–370, 3; 53/77, 85
See application file for complete search history.

(56) References Cited

U.S. PATENT DOCUMENTS

| | | | | |
|---|---|---|---|---|
| 3,335,765 | A | 8/1967 | Moonan | |
| 3,651,836 | A | 3/1972 | Johnson | |
| 4,938,260 | A | 7/1990 | Hirz | |
| 5,377,724 | A * | 1/1995 | Ray | 141/20 |
| 5,535,790 | A * | 7/1996 | Hirz | 141/20 |
| 5,740,841 | A * | 4/1998 | Hirz | 141/20 |
| 6,302,163 | B1 * | 10/2001 | Zeigler | 141/20 |
| 7,000,650 | B2 * | 2/2006 | Desjardins et al. | 141/20 |
| 7,523,768 | B2 * | 4/2009 | Chassaing | 141/20 |
| 7,909,070 | B2 * | 3/2011 | Chassaing | 141/20 |
| 2006/0042717 | A1 * | 3/2006 | Faure | 141/20 |
| 2007/0062599 | A1 | 3/2007 | Chassaing | |
| 2007/0062604 | A1 | 3/2007 | Chassaing | |

FOREIGN PATENT DOCUMENTS

| | | |
|---|---|---|
| CH | 458 965 A | 6/1968 |
| EP | 0 440 477 A1 | 8/1991 |
| FR | 2 890 940 A | 3/2007 |

* cited by examiner

*Primary Examiner* — Gregory Huson
*Assistant Examiner* — Nicolas A Arnett
(74) *Attorney, Agent, or Firm* — Young & Thompson

(57) ABSTRACT

An installation for filling an aerosol container with liquid, whereby the aerosol container including at least one frame, elements for holding a scoop of liquid for filling on the frame at a mount point located above the point where the aerosol container is mounted, a pushing element with a removable piston head, and elements that indicate when the piston head is not attached to the pushing element. The indicating elements assume the shape of a movable stop between an active position—in which the stop is placed on the trajectory followed by the scoop during its installation in its mount point on the frame and prevents the installation—and an inactive position—in which the stop allows the installation, whereby this stop, returned to the active position, is held in the inactive position by the piston head, in the attached state of the piston head on the pushing element.

15 Claims, 4 Drawing Sheets

INSTALLATION FOR FILLING AN AEROSOL CONTAINER WITH LIQUID, SUCH AS PAINT

This invention relates to an installation for filling an aerosol container with liquid, such as paint, whereby the aerosol container is of the type that comprises at least one frame, means for holding—in a removable manner—a scoop of liquid for filling on the frame at a mount point that is located above the point where the aerosol container is mounted, generally in a position of contact with the valve of said container, a pushing element with a removable piston head, and means that indicate when the piston head is not attached to the pushing element, whereby said pushing element can be moved axially in said scoop to bring about, by pushing on said liquid, the transfer of this liquid through an opening of the scoop, into the aerosol container, whereby the removable piston head is disengaged from the pushing element inside the scoop before the pushing element is withdrawn from said scoop.

Installations of the type mentioned above are described in the U.S. Pat. Nos. 4,938,260, 3,651,836, CH-458,965 and EP-0,440,477.

An example of such an installation is described in particular in the international application PCT WO 2007 034043. Such an installation is characterized by the fact that the pushing element is equipped with a piston head that can be removed and disengaged from the pushing element inside the scoop before withdrawing the pushing element from said scoop so as to keep the pushing element from being soiled during its travel. Owing to this design, at the end of the filling operation, the operator is prevented from any cleaning operation of the installation, since any contact between the installation and the filling liquid is carried out by means of the removable piston head that constitutes a consumable of said installation. However, this objective is not achieved when the operator neglects, before the filling or transfer operation, to equip the pushing element with its removable piston head. In this case, the pushing element is in direct contact with the filling liquid during its back-and-forth movement and should be cleaned after the liquid is transferred from the scoop to the aerosol container.

To solve this problem, it has been conceived to provide, in the pushing element that forms a piston, channels that empty into the open air, whereby, when the piston head does not close said channels, said channels prevent any rise in pressure of the chambers for actuating the piston, thereby making the transfer operation impossible. The drawback of such a solution is that it makes it necessary to use a pushing element of a complex design and with necessarily pneumatic operation. In addition, the air that is introduced into the channels comes, in the presence of the piston head, to rest on said head at the risk of disengaging in an ill-timed manner from the remainder of the pushing element.

One object of this invention is to propose a filling installation of the above-mentioned type whose design of the means that indicate when the piston head is not attached to the pushing element is a simplified design, whereby said means have no impact on the intrinsic operation of the pushing element.

For this purpose, the invention has as its object an installation for filling an aerosol container with liquid, such as paint, whereby said container is of the type that comprises at least a frame, means for holding—in a removable manner—a scoop of liquid for filling on the frame at a mount point that is located above the point where the aerosol container is mounted, generally in a position of contact with the valve of said container, a pushing element with a removable piston head, and means that indicate when the piston head is not attached to the pushing element, whereby said pushing element can be moved axially in said scoop to bring about, by pushing on said liquid, the transfer of this liquid through an opening of the scoop, into the aerosol container, whereby the removable piston head is disengaged from the pushing element inside the scoop before the pushing element is withdrawn from said scoop, characterized in that the means that indicate when the piston head is not attached to the pushing element assume the shape of a movable stop between an active position—in which said stop is placed on the trajectory followed by said scoop during its installation in its mount point on the frame and prevents said installation—and an inactive position—in which said stop allows said installation, whereby this stop, returned to the active position, is held in the inactive position by the piston head, in the attached state of the piston head on the pushing element.

Owing to the presence of a movable stop that forms an obstacle to the installation of the scoop, in or on the frame when the piston head is not attached to the pushing element, any risk of the pushing element being soiled owing to the piston head not being attached to said element is avoided.

The invention will be well understood from reading the following description of sample embodiments, with reference to the accompanying drawings in which.

Figure 3:
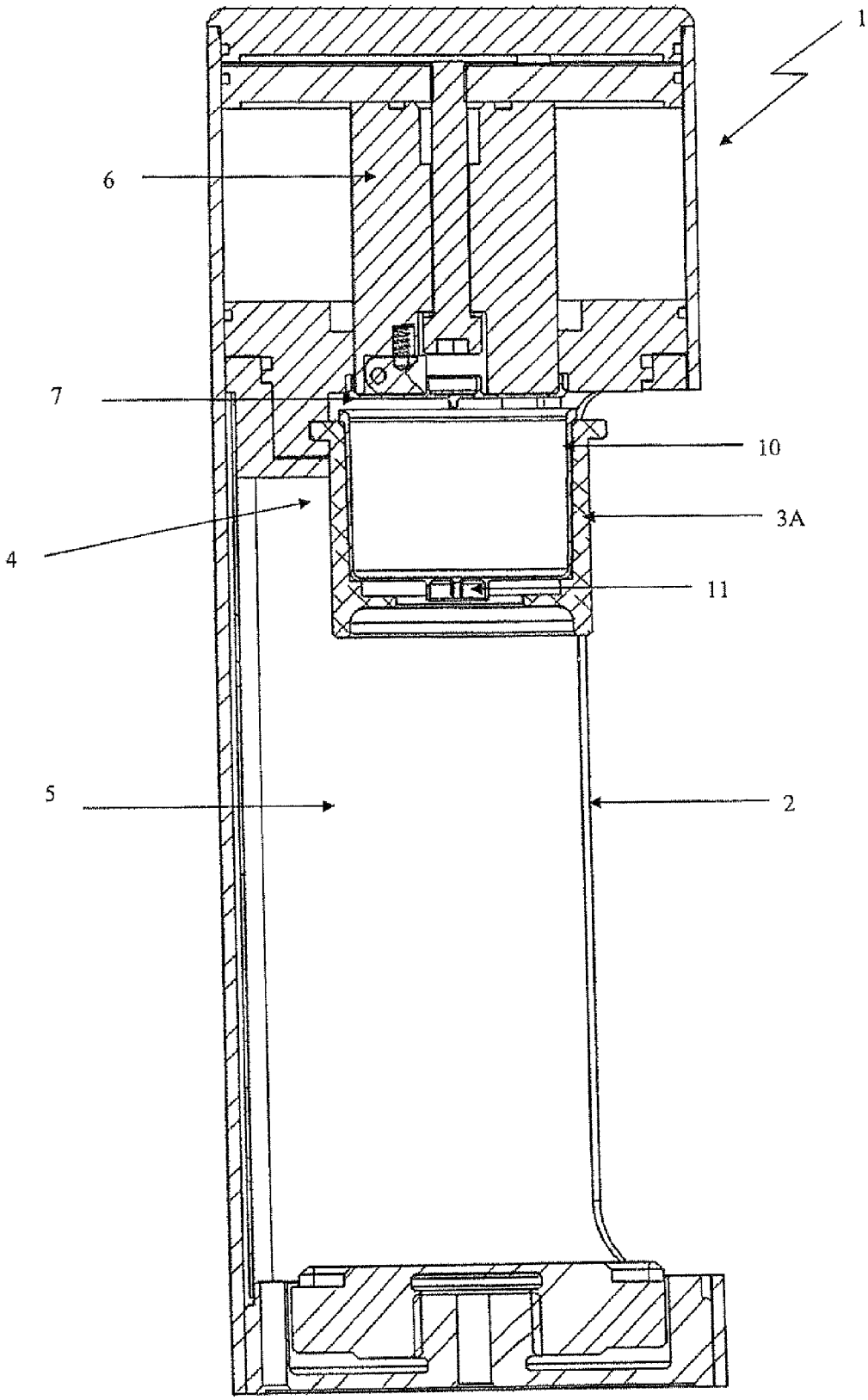
Figure 4:
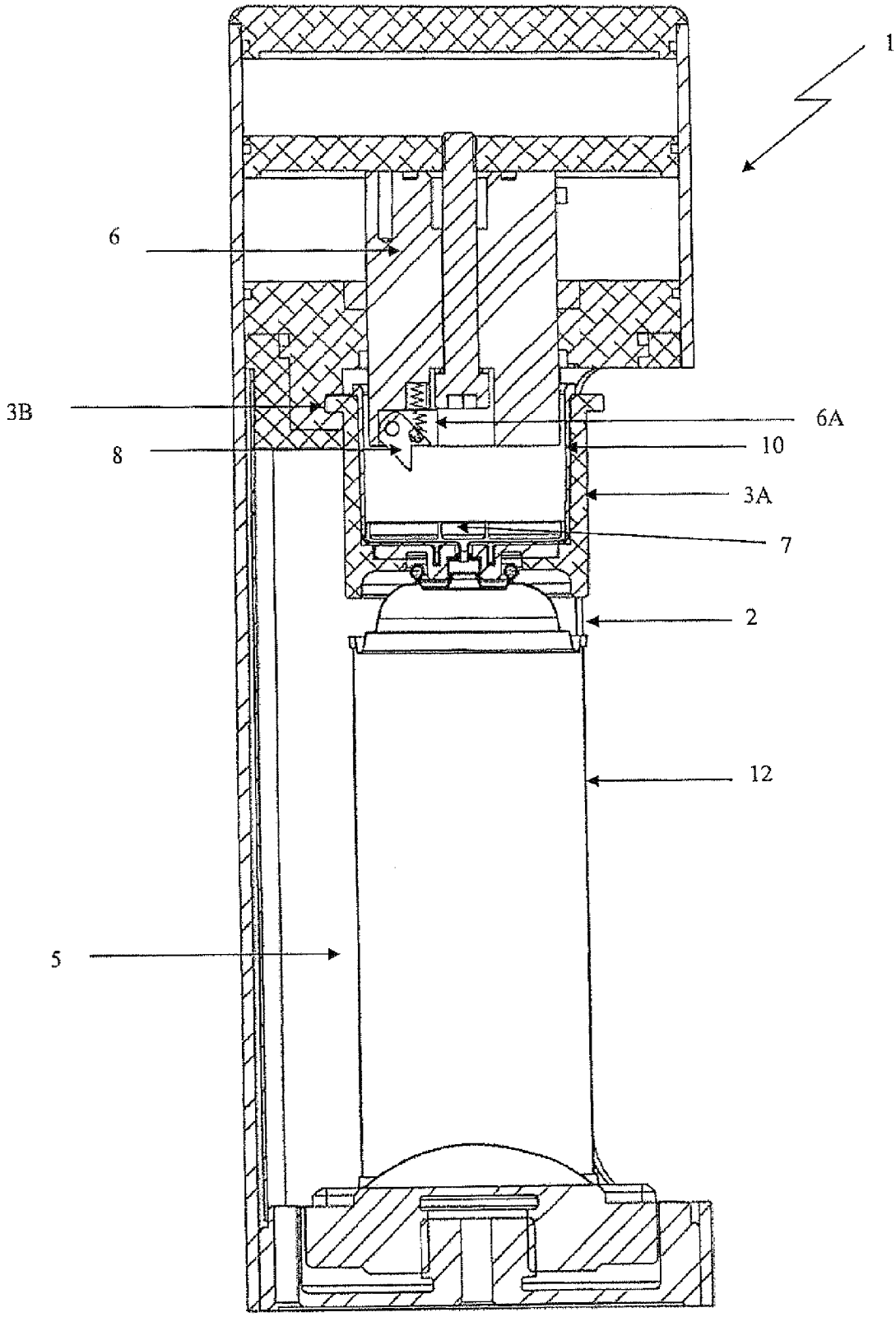

FIG. 3 shows a cutaway view of a filling installation according to the invention in the inactive position of said stop before the filling liquid is transferred from the scoop to the aerosol container, and FIG. 4 shows a cutaway view of a filling installation according to the invention in the active position of said stop after the filling liquid is transferred from the scoop to the aerosol container and disengagement of the piston head from the pushing element.

As mentioned above, the filling installation, object of the invention, is more particularly designed to allow the aerosol container 12, which generally comes in the form of a cylindrical body equipped with a valve on its upper part, to be filled with liquid, in particular paint. On top of this valve is a removable diffuser that makes it possible to diffuse the liquid that is contained inside the aerosol container into the atmosphere. This diffusion is achieved using a propellant gas that is contained inside the aerosol container. The filling of the aerosol container with liquid to be sprayed is carried out by the valve of the aerosol container. The filling requires a filling installation according to the invention.

This filling installation conventionally comprises a frame 1, means 3A, 3B for holding, in a removable manner, a scoop 10 of liquid for filling on the frame 1 in a mount point 4 that is located above the point 5 where the aerosol container is mounted, generally in a position of contact with the valve of said container, a pushing element 6 with a removable piston head 7, and means that indicate when the piston head 7 is not attached to the pushing element 6. This pushing element 6 can be moved axially in the scoop 10 to bring about, by pushing on said liquid, the transfer of this liquid through an opening 11 of the scoop into the aerosol container. The removable piston head 7 is disengaged from the pushing element 6 inside the scoop 10 before the pushing element 6 is withdrawn from the scoop 10.

In the examples that are shown, the frame 1 delimits a chamber, generally of the column type, equipped with a front inlet 2, which can preferably be closed, for inserting the scoop 10 and the aerosol container 12 into said chamber. This frame 1 generally houses the scoop 10 and the aerosol container in the suspended state of the scoop in said chamber that is delimited by the frame. The installation and the removal of the scoop and the aerosol container of the chamber that is delimited by the frame 1 is carried out by means of an inlet 2 that is generally equipped with a pivoting or sliding door.

To make it possible to hold, in particular in suspension, the scoop 10 inside the chamber of the frame 1 at a mount point 4 that is located above the point 5 where the aerosol container is mounted, the scoop 10 is, before insertion into the frame 1, housed inside a scoop-carrier 3A. This scoop-carrier, with a shape that mates with said scoop, is equipped with an annular, external, circumferential shoulder that works with slides 3B that are made along the internal peripheral walls of the frame 1. These holding means 3A, 3B will not be described in more detail below.

In its face that forms the bottom, the scoop 10 is equipped with an injection opening 11 that generally extends outside of a projection that forms an injection nozzle that can be positioned on the valve of the aerosol container. The injection opening of the scoop can therefore be adapted to the valve of the aerosol container and is more particularly designed to engage with the latter. The pushing element 6 acts by pushing on the filling liquid that is contained in the scoop 10 to transfer it from the scoop 10 to the aerosol container 12. Thus, the scoop 10 is positioned, in a first step, with its injection opening 11 opposite the valve of the aerosol container, whereby said opening with its projection is inserted into the valve. The filling liquid that is contained inside the scoop 10 is, under the action of an axial movement of the pushing element 6 inside the scoop 10, transferred from the scoop 10 to the aerosol container 12. This pushing element 6 is equipped with a removable piston head 7 that is disengaged from the pushing element inside the scoop 10 before the pushing element 6 is withdrawn from said scoop 10. This piston head 7—which is shaped to work with the scoop to ensure that, after transfer, the piston head 7 is held inside the scoop 10 and to form an airtight wall that imprisons the residual liquid that is not transferred to the inside of the scoop—is held in the scoop 10 in a final transfer position close to the bottom of the scoop in which it closes the injection opening 11 of the scoop 10. Generally, the piston head 7 comes in the form of a circular disk, with a scraper segment for radial sealing, whereby this disk is extended by a circular skirt that is designed to cover the pushing element 6. Thus, the piston head 7 is attached to the pushing element by simple interlocking. The pushing element 6 forms the piston of a hydraulic or pneumatic jack whose body is formed by at least one part of the frame 1 of the installation. This pushing element 6 assumes the shape here of a cylindrical body that is equipped with an external, peripheral, circular shoulder. This body with shoulders makes it possible to form, on both sides of the zone with shoulders, each time, a chamber that, in the state supplied with fluid, causes the piston to move axially in one direction. When the removable piston head 7 is removed from the pushing element 6, the risk is that the pushing element will plunge directly into the scoop that contains the filling liquid and will become soiled upon contact with the liquid, making it necessary to clean said element after each transfer operation.

To prevent such a problem, the filling installation comprises means that indicate when the piston head 7 is not attached to the pushing element 6. These indicating means assume here the shape of a stop 8 that can move between an active position (FIG. 2), in which said stop 8 is placed on the trajectory followed by said scoop 10 during its installation in its mount point on the frame 1 and prevents said installation, and an inactive position (FIG. 3), in which said stop 8 allows the installation of the scoop 10 in its mount point 4 on the frame 1, whereby this stop 8, returned to the active position, is kept in the inactive position by the piston head 7, in the attached state of the piston head 7 on the pushing element 6.

Figure 1:
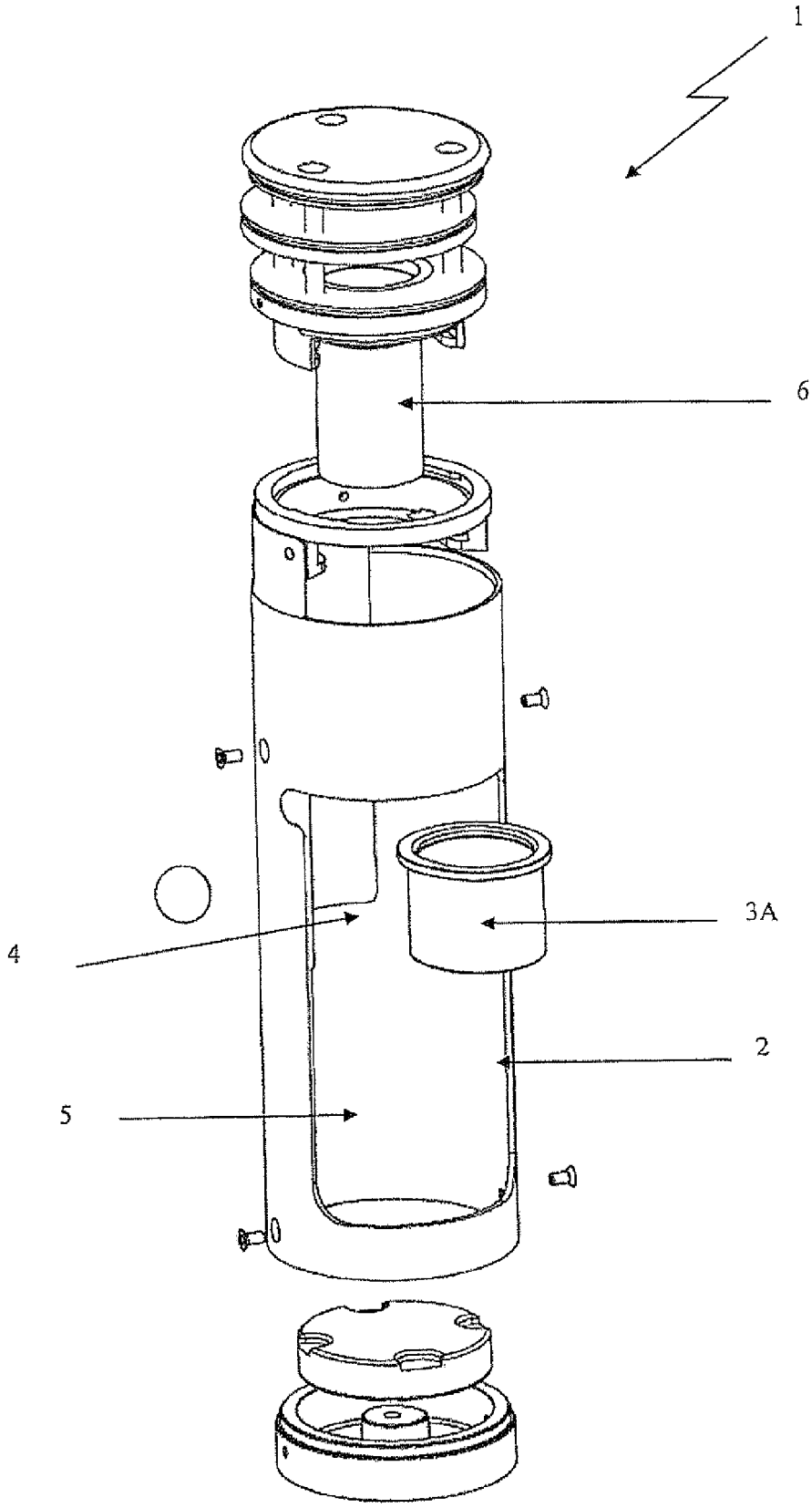
FIG. 1 shows a perspective view of a liquid-filling installation according to the invention, whereby the elements that comprise it are shown in exploded view.
Figure 2:
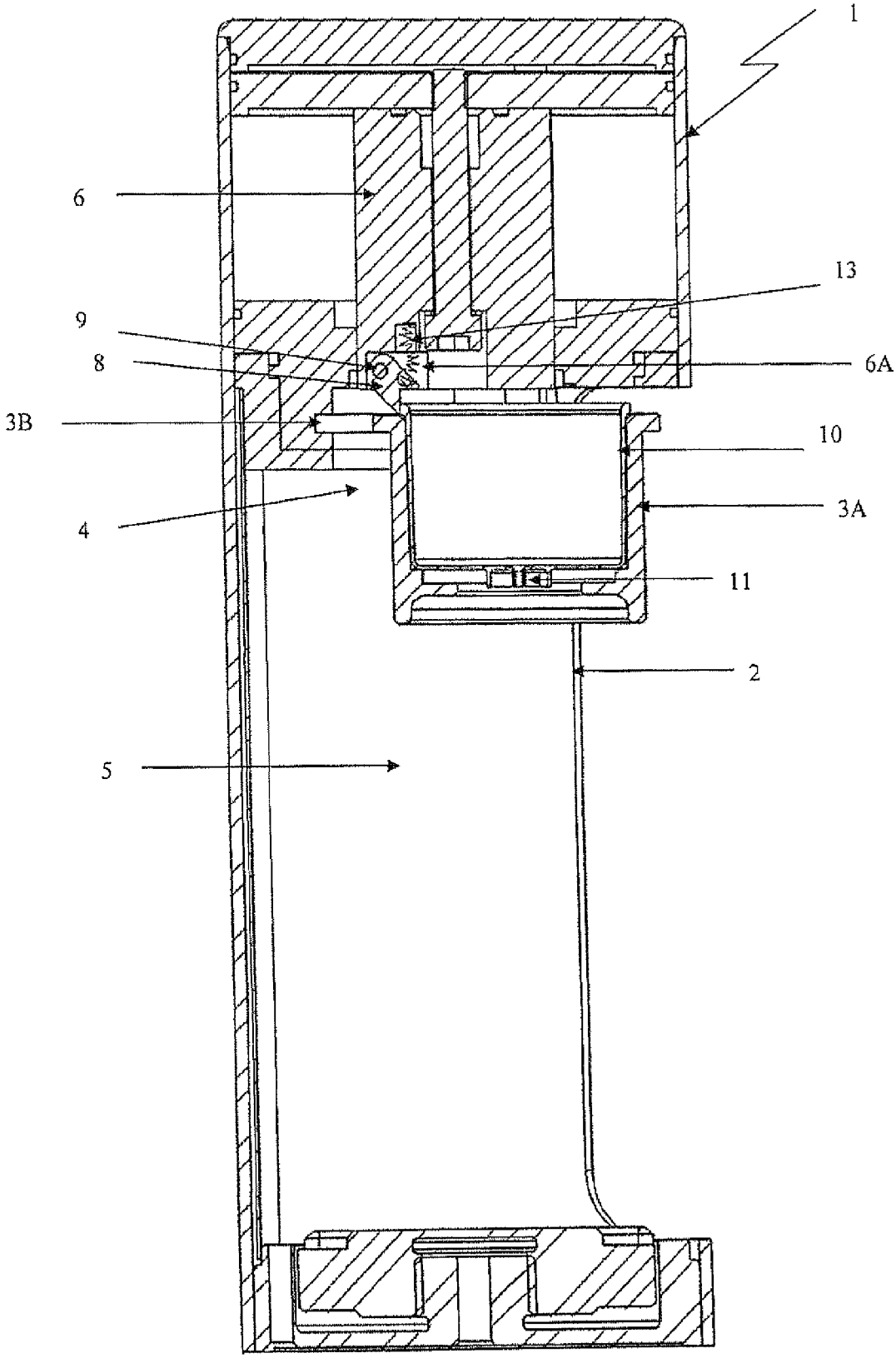
FIG. 2 shows a cutaway view of a filling installation according to the invention in the active position of the stop.

The stop 8 is returned to the active position at least under the action of its own weight. In the examples that are shown, the stop 8 is loaded by a spring 13 that returns the stop 8 to the active position. This stop 8 is, in the examples shown, mounted on the pushing element 6. This stop 8 is placed in or close to the free end of the pushing element 6. In the active position, this stop 8 forms an extension of the pushing element 6. In the inactive position, this stop 8 is retracted into a housing 6A of the pushing element 6. In the active position, the stop 8 projects and extends beyond the free end of the pushing element 6 into a position in which it prevents the installation of the scoop and its scoop-carrier in the chamber that is delimited by the frame 1 as FIG. 2 illustrates. In the examples that are shown, the stop 8 assumes the shape of a lever that pivots around an axis 9 that is orthogonal to the direction of axial movement of the pushing element 6. The free end of the stop 8 that forms an obstacle to the installation of the scoop 10 in its mount point 4 in the active position of said stop 8 is shaped like a corner. The planes of the convex angle that is formed by the corner constitute support and stop surfaces of the scoop during its insertion into the mount point 4. An inclined face made on the periphery of the lever, close to the end of the lever equipped with the pivot axis 9, rests against an inside wall of the housing of the lever and prevents, in the active position of the lever, the angular movement of said lever beyond a predetermined position under the action of the force exerted by the operator for inserting the scoop into its mount point.

In such an installation, in which the frame 1 delimits a chamber that is equipped with an inlet 2, which preferably can be closed, for inserting the scoop 10 and the aerosol container into said chamber, the stop 8 forms, in the active position, a ramp that is inclined in a descending manner from its zone for connection to the pushing element 6 in the direction of the inlet zone 2 of the scoop in the frame 1 so as to prevent, in said position, the access of the scoop 10 to the mount point 4 for receiving the scoop but to allow the extraction of the scoop 10 from said mount point 4. Actually, as FIG. 4 illustrates, in the end transfer position, the piston head 7 is held inside the scoop 10 such that the piston that constitutes the pushing element is, when it is withdrawn from the scoop, free of the piston head 7. The stop therefore returns into its active position in which it prevents the insertion of the scoop into its mount point on the frame 1. In contrast, because of the orientation of the inclined ramp and because it is inclined in the direction of the inlet, it in no way prevents the scoop 10 from exiting from its mount point 4. It should be noted that the installation and the removal of the scoop-carrier 3A are in no way restricted by the stop 8, which, in each of its positions, leaves the passage of the scoop-carrier 3A free so as to be able to store the scoop-carrier inside the chamber of the installation, in particular during phases of transport, storage or inactivity of said installation.

As FIG. 3 illustrates, the piston head 7 is attached to the pushing element 6 by simple interlocking. In the state in which it is attached to the pushing element 6, the piston head 7 covers the free end of the pushing element 6 and the stop 8 that equips said end. It thus holds the stop 8 in a retracted position inside the housing 6A that is made in said pushing element 6. The presence of such a stop does not at all modify the operation of the filling installation compared to a traditional filling installation. Actually, the procedure is performed in a manner analogous to that which is performed for a traditional filling installation.

The operations are generally as follows, whereby the order can be modified:

The scoop-carrier 3A is positioned on the aerosol container 12,

Next, the scoop 10 is inserted into the scoop-carrier 3A such that the injection opening 11 of the scoop 10 engages with the valve of the aerosol, The scoop 10 is filled with filling liquid, The removable piston head 7 is installed on the pushing element 6, then the filled aerosol and scoop 10 unit is positioned in the chamber that consists of the frame of the installation, whereby the external circular shoulder of the scoop-carrier comes into slides of said frame.

The door of the chamber, when it is present, is closed. The closing of this door entrains the actuation of the pushing element and in particular the descent of the piston that constitutes the pushing element and the piston head in the scoop that entrains the transfer of the filling liquid from the scoop to the aerosol. When the piston head 7 reaches the bottom of the scoop 10, it is held inside the latter. The pushing element 6 is then moved in the direction of an extraction or a withdrawal of said scoop and returns to its initial position. The aerosol container and scoop unit can then be extracted from the chamber that consists of the frame 1 of the installation. A new transfer operation can then be performed after a new piston head has been repositioned on the pushing element and a new scoop has been repositioned in the scoop-carrier. No cleaning operation of the installation is necessary before operating this new transfer operation. An extremely easy implementation of the unit results therefrom.

Quite obviously, if the piston head 7 is left out, the operator cannot position the aerosol and scoop 10 unit in the chamber that is formed by the frame 1.

The invention claimed is:

1. An installation for filling an aerosol container (12) with liquid, comprising:

one frame (1), means (3A, 3B) for holding, in a removable manner, a scoop (10) of liquid for filling on the frame (1) at a mount point (4) that is located above the point (5) where the aerosol container is mounted, generally in a position of contact with a valve of said aerosol container (12), a pushing element (6) with a removable piston head (7), and means that indicate when the piston head (7) is not attached to the pushing element (6), wherein the pushing element (6) is moved axially in said scoop (10) to bring about, by pushing on said liquid, a transfer of this liquid through an opening (11) of the scoop, into the aerosol container, whereby the removable piston head (7) is disengaged from the pushing element (6) inside the scoop (10) before the pushing element (6) is withdrawn from said scoop (10), wherein the means that indicate when the piston head (7) is not attached to the pushing element (6) assume a shape of a movable stop (8) between an active position, in which said stop (8) is placed on a trajectory followed by said scoop (10) during installation of said scoop (10) in the mount point (4) on the frame (1) and prevents said installation and an inactive position, in which said stop (8) allows said installation, wherein the stop (8) is returned to the active position, is held in the inactive position by the piston head (7) in an attached state of the piston head (7) on the pushing element (6).

2. The installation according to claim 1, wherein said stop (8) is returned to the active position at least under an action of said stop's own weight.

3. The installation according to claim 2, wherein the stop (8) is mounted on the pushing element (6).

4. The installation according to claim 2, wherein the stop (8) assumes the shape of a lever that pivots around an axis (9) that is orthogonal to a direction of axial movement of the pushing element (6).

5. The installation according to claim 1, wherein the stop (8) is mounted on the pushing element (6).

6. The installation according to claim 5, wherein said stop (8) is placed at or close to a free end of the pushing element (6).

7. The installation according to claim 6, wherein the piston head (7) is attached to the pushing element (6) by simple interlocking and wherein in the state attached to the pushing element (6), the piston head (7) covers the free end of the pushing element (6) and the stop (8) that equips said end.

8. The installation according to claim 6, wherein in the active position, the stop (8) forms an extension of the pushing element (6), and wherein in the inactive position, the stop (8) is retracted into a housing (6A) of the pushing element (6).

9. The installation according to claim 5, wherein the piston head (7) is attached to the pushing element (6) by simple interlocking and wherein in the state attached to the pushing element (6), the piston head (7) covers a free end of the pushing element (6) and the stop (8) that equips said free end.

10. The installation according to claim 9, wherein in the active position, the stop (8) forms an extension of the pushing element (6), and wherein in the inactive position, the stop (8) is retracted into a housing (6A) of the pushing element (6).

11. The installation according to claim 5, wherein in the active position, the stop (8) forms an extension of the pushing element (6), and wherein in the inactive position, the stop (8) is retracted into a housing (6A) of the pushing element (6).

12. The installation according to claim 5, wherein the stop (8) assumes the shape of a lever that pivots around an axis (9) that is orthogonal to a direction of axial movement of the pushing element (6).

13. The installation according to claim 1, wherein the stop (8) assumes the shape of a lever that pivots around an axis (9) that is orthogonal to a direction of axial movement of the pushing element (6).

14. The installation according to claim 13, wherein the frame (1) delimits a chamber that is equipped with a closable inlet (2), for inserting the scoop (10) and the aerosol container (12) into said chamber, wherein the stop (8) forms, in the active position, an inclined ramp in a descending manner from a zone of the stop (8) for connection to the pushing element (6) in a direction of the inlet zone (2) of the scoop in the frame (1) so as to prevent, in said position, access of the scoop (10) to the mount point (4) for receiving the scoop but to allow an extraction of the scoop (10) from said mount point (4).

15. The installation according to claim 14, wherein the inlet (2) is closed during filling of the aerosol container (12).

* * * * *